US005836029A

United States Patent [19]

Garber et al.

[11] Patent Number: 5,836,029

[45] Date of Patent: Nov. 17, 1998

[54] METHOD OF PREPARING AN ALUMINUM BRIDGE DECK AND AN ALUMINUM BRIDGE DECK CONFIGURATION FOR RECEIVING A WEARING SURFACE

[75] Inventors: Douglas W. Garber, Midlothian; John R. Weir; Bruce Robbins, both of Richmond, all of Va.

[73] Assignee: Reynolds Metals Company, Richmond, Va.

[21] Appl. No.: 734,832

[22] Filed: Oct. 22, 1996

[51] Int. Cl.[6] ..... E01D 21/00; E01D 19/12

[52] U.S. Cl. ..... 14/77.1; 14/73; 14/73.1

[58] Field of Search ..... 14/73, 73.1, 77.1

[56] References Cited

U.S. PATENT DOCUMENTS

| | | | |
|---|---|---|---|
| 4,709,435 | 12/1987 | Stemler et al. | 14/73 |
| 5,033,147 | 7/1991 | Svensson | 14/73 |
| 5,651,154 | 7/1997 | Ahlskog et al. | 14/6 |

OTHER PUBLICATIONS

"Phosphate Conversion Coating," www.mahidol.ac.th/mahidol/eg/em proj/group13/phosphat.htm, undated.

Betz Material Safety Data Sheet, Jan. 23, 1995.

Dural, Tamms –Flexolith Polymer Concrete Bridge Deck Overlay.

Tamms Industries, Overview of Flexolith Epoxy Overlay System, Presented To: MTA Bridges & Tunnels, Randall's Island, NY.

Tamms Industries, DIV Laporte, Material Safety Data Sheet for Flexolith 216 (111), Part A, Printed Nov. 3, 1993.

Tamms Industries, DIV Laporte, Material Safety Data Sheet for Flexolith 216 (111), Part B, Printed Nov. 3, 1993.

*Primary Examiner*—Tamara L. Graysay
*Assistant Examiner*—Gary S. Hartmann
*Attorney, Agent, or Firm*—Alan M. Biddison

[57] ABSTRACT

An aluminum alloy bridge deck construction is disclosed with a wearing surface applied thereto. The surface of the welded-together extrusions of the bridge deck is treated so that a tight bond is formed between the wearing surface and the extrusion surface. When splicing bridge deck segments together, the joint extrusions forming part of the bridge deck include a wearing surface dam on an upper surface thereof. The wearing surface dam acts as a separator between a wearing surface previously applied to the bridge deck surface prior to its splicing and a surface which receives the wearing surface after the joint is made in the field.

7 Claims, 3 Drawing Sheets

METHOD OF PREPARING AN ALUMINUM BRIDGE DECK AND AN ALUMINUM BRIDGE DECK CONFIGURATION FOR RECEIVING A WEARING SURFACE

FIELD OF THE INVENTION

The present invention is directed to aluminum alloy bridge decks and, in particular, to a method of bridge deck surface preparation and a bridge deck configuration to facilitate application of a wearing surface thereto.

BACKGROUND ART

Bridges having aluminum alloy bridge decks are well known in the art. For example, an aluminum alloy bridge deck was installed in the 1930's as part of the Smithfield Street Bridge in Pittsburgh Pa. Aluminum alloy bridge deck structures are preferred by reason of their light weight, corrosion resistance and easy handling, particularly for field installation. Because aluminum alloy bridge deck surfaces are not inherently wear or skid resistant, a wearing surface needs to be applied to the top surface of the aluminum forming the deck. References made to the bridge deck surface describe the top surface of the aluminum that receives and bonds with the wearing surface.

One problem associated with aluminum alloy bridge decks is the difficulty in bonding a wearing surface thereto. Aluminum alloy bridge decks are fundamentally different than known steel or concrete decks and pose unique problems related to wearing surface bonding.

Another problem with wearing surface-containing aluminum alloy bridge decks relates to a bridge construction wherein two or more segments may be joined together to form an entire bridge deck. For reasons described later, the majority of the wearing surface is applied in a shop prior to installation of the bridge deck. The wearing surface around areas of the joints of adjacent sections needs to be applied in the field, after the segments are joined as part of the bridge deck installation process. Difficulties may be encountered at the segment joints because wearing surface applied in the field to the area of the joint might not form a good bond with the wearing surfaces previously applied to the segments being joined. Consequently, the wearing surfaces in the vicinity of the joint may be susceptible to breakdown or delamination, thereby causing both an uneven bridge surface and a need for increased frequency of bridge wearing surface repair.

In view of the disadvantages noted above, a need has developed to provide an improved method for achieving a satisfactory bond between a wearing surface and an aluminum alloy bridge deck and a configuration which facilitates joining adjacent bridge deck segments.

In response to this need, the present invention offers a method which improves the bonding between a wearing surface and a bridge deck surface. The present invention also sets forth a deck configuration which eliminates the need to bond one wearing surface to another at bridge deck joints.

SUMMARY OF THE INVENTION

Accordingly, it is a first object of the present invention to provide a method which improves the bonding between a wearing surface and an aluminum alloy bridge deck surface.

Another object of the present invention is to provide a method which permits application of the majority of the wearing surface to an aluminum alloy bridge deck prior to its installation in the field, thereby minimizing adverse environmental effects during bridge deck surface preparation.

A further object of the invention is to provide a bridge deck surface which is treated to enhance bonding to a wearing surface.

A still further object of the present invention is to provide a bridge deck joint construction which eliminates the need to bond wearing surfaces of adjacent bridge deck segments together.

Yet another object of the present invention is to provide a method of making a joint extrusion for bridge deck segments which overcomes the problem in attempting to bond wearing surfaces to each other.

Other objects and advantages of the present invention will become apparent as a description thereof proceeds.

In satisfaction of the foregoing objects and advantages, the present invention provides a method of preparing an aluminum alloy bridge deck surface for application of a wearing surface by the steps of first providing an aluminum alloy bridge deck made up of a plurality of aluminum alloy extrusions. The extrusions are welded together at sides thereof to form a deck surface with the welds therein.

The weld-containing aluminum alloy bridge deck surface or at least a portion thereof is then buffed to remove loosely adherent debris, heat scale, weld flux and dirt. The buffing step may be performed using a nylon buffing material such as a Scotch Brite® pad. Following buffing, the deck surface is then cleaned so as to remove all foreign material, particularly organic material and rinsed to form an essentially water break free deck surface. A conversion coating is then formed on the water break free deck surface to receive the wearing surface. Preferably, the conversion coating is applied in aqueous solution form to the water break free deck surface while it is still coated with the rinsing water.

The wearing surface is preferably a polymer concrete. In addition, it is preferred to prepare the deck surface and apply the wearing surface prior to installation of the bridge deck to a given bridge structure. This allows for more control over the surface preparation steps and minimizes the potential for release of potentially harmful materials into the environment and decreases the total installation time at the bridge site.

The surface preparation method can also be performed as part of an existing bridge repair by following the steps described above.

In another aspect of the invention, one or more of the extrusions forming the aluminum alloy bridge deck is extruded in the form of a joint to facilitate attaching one deck segment to another to complete a bridge structure. The joint extrusion can be extruded with a raised portion on an upper surface thereof to form first and second wearing surface-receiving upper surfaces. The raised portion is extruded in a longitudinal direction of the extrusion and acts as a wearing surface dam. The wearing surface dam serves to separate the wearing surface when applied to the first wearing surface-receiving upper surface in a shop environment and a wearing surface that is applied to the second wearing surface-receiving upper surface when joining the bridge deck segments in the field. With the wearing surface dam, the previously applied wearing surface is separated from the wearing surface applied in the field and problems with bonding therebetween are avoided.

Preferably, the height of the wearing surface dam approximates the thickness of the applied wearing surface and includes a flat upper surface with sides concavely shaped towards the upper surface of the joint extrusion.

The invention also provides an aluminum alloy bridge deck which is designed to receive the conversion coating and subsequent wearing surface wherein the bridge deck is buffed and cleaned as described above to form an essentially water break free surface. With this water break free surface, the wearing surface is bonded tightly to the aluminum alloy bridge deck surface via the conversion coating.

The present invention also sets forth an aluminum alloy bridge deck joint extrusion wherein the extrusion has one of an isotropic or an orthotropic cross section and first and second wearing surface-receiving upper surfaces. The two upper surfaces are separated by a raised portion along the length of the extrusion, the raised portion acting as a wearing surface dam to separate a wearing surface material applied to the second upper surface as part of a joint between adjacent aluminum alloy bridge deck segments and a wearing surface material previously applied to the first upper surface of the joint extrusion.

A preferred method of forming the joint extrusion is also disclosed wherein the raised portion is formed when extruding a length of an aluminum alloy.

BRIEF DESCRIPTION OF THE DRAWINGS

Reference is now made to the drawings of the invention wherein.

DESCRIPTION OF THE PREFERRED EMBODIMENTS

The present invention solves several of the problems faced in the prior art when making aluminum alloy bridge decks. First, in a method aspect of the invention, an aluminum alloy bridge deck surface is prepared to receive a wearing surface so as to form a tight bond which provides a long life road surface.

Second, the inventive method minimizes the possibility of adverse impact on the environment by installing all or a majority of the wearing surface on an aluminum alloy bridge deck in a shop environment rather than in the field. By applying the wearing surface in this manner, control can be exercised over disposal of the materials used and/or generated during bridge deck surface preparation or wearing surface application. Also, by applying the wearing surface in a shop, less installation time is required at the bridge site.

The present invention also solves a problem when joining deck segments by utilizing a novel joint design and method of manufacture. With this joint design, the need to abut wearing surfaces of adjacent bridge deck segments is eliminated or minimized. Thus, once a shop-formed bridge deck segment is installed with a wearing surface applied thereon, a wearing surface need only be applied to the aluminum alloy surface of the joint rather than attempting to bond one wearing surface to another.

Figure 1:
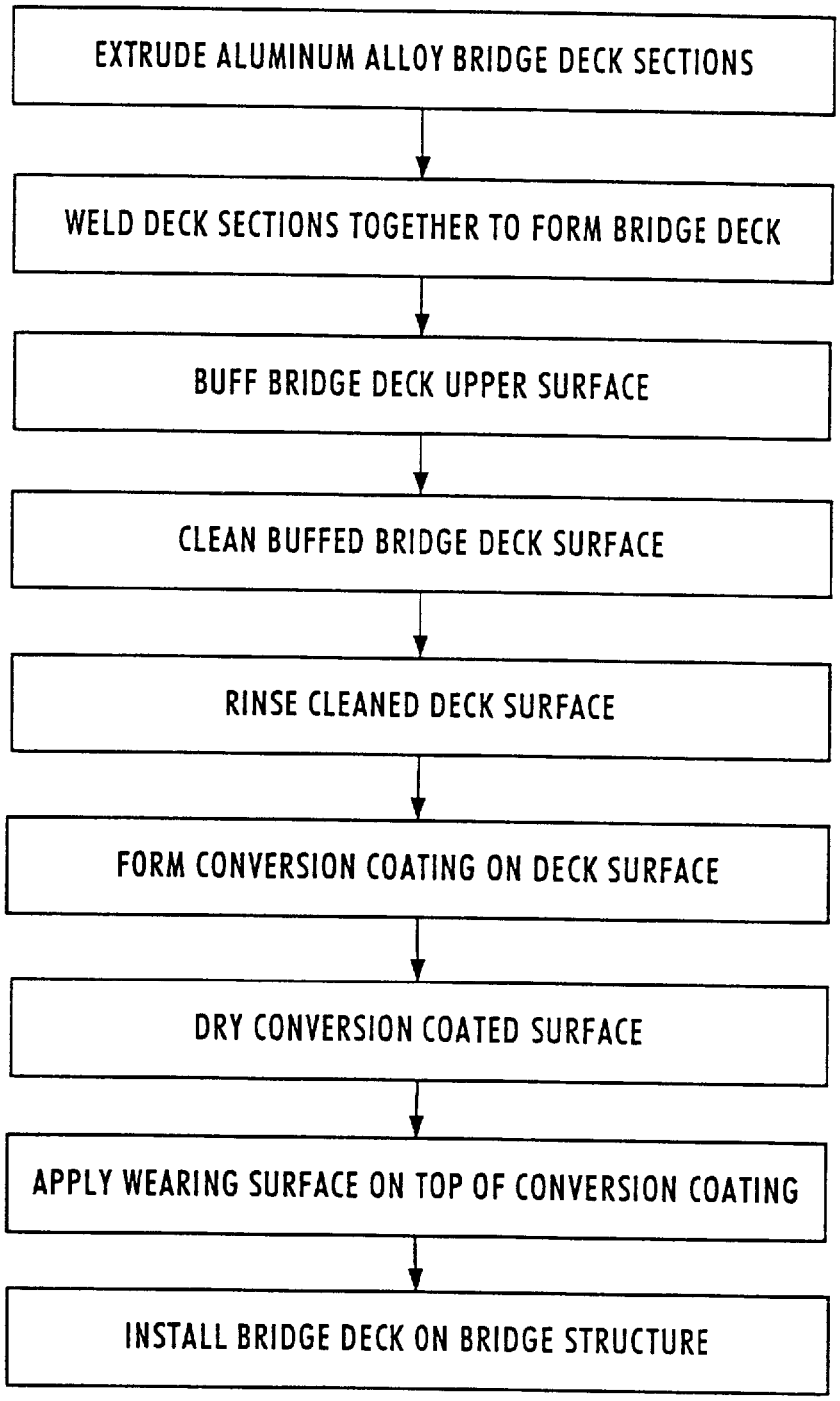
FIG. 1 is a schematic block diagram of one mode of the inventive method.

Referring now to FIG. 1, a schematic flow diagram of one mode of the inventive method is depicted. This mode describes a method of not only bridge deck surface preparation but also includes the general steps of making the bridge deck and installing it.

First, aluminum alloy bridge deck sections are extruded in a desired shape. Typically, these deck sections have an isotropic or orthotropic cross-sectional design as is known in the art. A preferred cross-section design includes the design disclosed in commonly owned U.S. patent application Ser. No. 08/556,359, filed Nov. 13, 1995, herein incorporated in its entirety by reference.

Once the aluminum alloy deck sections are extruded, they are welded together along sides thereof to form the bridge deck.

During the welding process, smut adheres to portions of the surface of the bridge deck, including the weld surface itself, the heat-affected zone and the non heat-affected zones, i.e. the remaining upper surfaces of the bridge deck. Consequently, the overall surface of the bridge deck is not uniform in nature by reason of the presence of smut and any other impurities, e.g., loose natural oxides or other contaminants that may exist on the surface. These impurities and areas of non-uniformity should be removed so that a tight bond is formed when the bridge deck surface is coated with the wearing surface.

The bridge deck surface is thus prepared by subjecting it to a mechanical finishing process which removes the smut produced by welding, other loose oxides and contaminants on the bridge deck surface. There is no need to change the topography of the bridge deck surface. Rather, it is only necessary to remove the loose and other weakly bonded oxides or other materials from the surface. The mechanical finishing of the bridge deck surface also reduces any aluminum oxide formed in the heat-affected zone as the result of the welding process so that the surface of the bridge deck surface in terms of an oxide coating is generally uniform in composition but not necessarily in thickness between the weld bead area, the heat-affected zones and the other surface areas.

Preferably, the mechanical finishing is accomplished by scrubbing the welds and heat-affected areas and, if necessary, the remaining bridge deck surface with an abrasive, non-metallic pad such as a nylon buffing pad. One example of such a buffing pad is a VF Scotch Brite® pad. With this mechanical finishing, the resultant oxide in all surface areas of the bridge deck is generally less than 300 angstrom counts equivalent thickness and generally more than 25 angstrom counts equivalent thickness. This unit of measurement is determined by extrapolation of oxygen X-ray flux density of the unknown between the flux densities of standards of known thickness. This procedure does not discriminate the source of the oxygen and denser oxides will be seen as thicker oxides but it is assumed that the known thickness barrier film standards are similar in composition and density to the oxide on the bridge deck surface. The known thickness barrier oxide film standards are prepared using the known standard method of anodizing in a borate electrode at a voltage appropriate for the thickness standard that is required.

The buffing can be done using any known techniques, including manual buffing or by machine.

During the buffing step, natural oxide may also be removed. However, a new layer will form to its natural thickness and even if natural oxide is removed, the buffed bridge deck surface will have a uniform natural oxide layer uniform in composition substantially over its entirety for subsequent surface preparation.

Once the bridge deck surface is buffed, it is cleaned to remove any and all remaining foreign material such as organics, dirts or the like. The material used for cleaning the bridge deck surface should be a type that should remove these types of contaminants from the surface. Preferably, an alkaline soap solution is used. More preferably, in a laboratory environment the soap solution is an 8% solution of Oakite NST in tap water at 120° F. Of course, other types of cleaners may be used providing they achieve the purpose cited above. The cleaning solution can be applied in any known fashion, e.g., spraying, brushing or the like. It should be appreciated that different temperatures may be appropriate to compensate for cooling of the cleaning solution by the mass of the bridge deck. For instance, a set point of 180° F may be desirable when the solution is sprayed on the deck.

Once the bridge deck surface is cleaned, it is rinsed to remove residual cleaner and any reaction products from the cleaning step. The sufficiency of the cleaning process is verified during the rinsing step by the presence of a "water break free surface" during rinsing. The term "water break free surface" is intended to reflect a clean surface which, when rinsed with water, does not generate any significant beading of water. In other words, the water covers the bridge deck surface as a sheet so that virtually no water droplets are formed. If water droplets or beads are formed, the cleaning step should be repeated since this is an indication that residual contaminants still remain on the bridge deck surface. The rinsing step can use ordinary tap water and, the water applied in any known fashion. Preferably, the water is softer in nature but this is not an absolute requirement for the rinsing step.

Following the rinsing step, a conversion coating is formed on the deck surface. Forming the conversion coating involves converting the bridge deck upper surface from a natural oxide outer layer to an oxide mixture including one or more non-aluminum oxides such as zirconium oxide, molybdenum oxide, chromium oxide, titanium oxide, and silicon oxide. Typically, the top 30 to 40 angstroms of the natural oxide is converted during formation of the conversion coating. One result of the conversion coating formation is creation of a layer having better chemical resistance than the natural oxide layers on the bridge deck upper surface. For example, if the upper surface is exposed to water at an interface between an applied wearing surface and the upper surface, the water can react with the aluminum oxide to adversely affect the bond between the wearing surface and the upper surface. Formation of the conversion coating with non-aluminum oxides as a part thereof reduces or eliminates the potential of water to react with the aluminum oxide.

The conversion coating also results in a higher bond strength between the applied wearing surface material and the bridge deck upper surface.

The conversion coating is typically formed by making an aqueous solution of a conversion coating material and applying it to the bridge deck surface using known techniques such as spraying, immersion, roll coating or the like. Preferably, the conversion coating aqueous solution is applied while the bridge deck surface is still covered by the rinse water. This enhances the wetting of the bridge deck surface with the conversion coating solution.

Depending on the conversion coating selected, rinsing after application of the coating may be required to remove any residual solution and undesired reaction products. Alternatively, some conversion coatings can be merely applied without a subsequent rinsing step. A preferred conversion coating is a 1% aqueous solution of DC1903R, a conversion coating material manufactured by BETZ, Laboratories of Trevose, Pa., wherein the solution is applied with a paint roller.

After the conversion coating is applied, a drying step is conducted. The conversion coating can merely be dried under ambient conditions or be subjected to convection or radiant drying if the weather conditions dictate such drying, e.g., application of the conversion coating during winter conditions.

Once the conversion coating is formed, a wearing surface is applied thereto. The wearing surface acts as the road surface for travel across the bridge. Although any known wearing surface can be utilized with the instant invention, a polymer concrete type wearing surface is preferred. Typically, these polymer concrete systems comprise polyester based, methylacrylate-based and epoxy resin-based systems. Although any of these types of polymer concretes can be utilized with the instant invention, the epoxy resin-based system is believed to be superior to the other systems mentioned above.

The epoxy resin-based polymer concrete comprises a two part system, one part being an epoxy hardener with the second part being the epoxy base. The polymer concrete also includes an aggregate material. The aggregate material can be any known type but is typically a silica, alumina or basalt.

The aggregate is mixed with the two part epoxy resin-based system and then applied to the conversion coated bridge deck upper surface by any known method. Typically, the polymer concrete is applied at a target thickness of about ⅜" thick, but may be thinner or thicker in some areas depending on the flatness of the aluminum alloy bridge deck surface. The thickness of the coating in some areas may be in the range of ¾" to 1". Of course, thicker target coatings may be applied, but are usually cost ineffective. Once the polymer concrete is applied, a further aggregate layer can then be broadcast over the surface of the applied polymer concrete, the final aggregate broadcasting being performed prior to curing of the thus applied polymer concrete.

A preferred polymer concrete for use with the invention is a Flexolith polymer concrete system manufactured by TAMMS Industry Company of Mentor, Ohio. In this system, a combination of a BIS A epoxy resin and 2 ethyl-hexyl glycidyl ether is used as the base and the combination of a phenol, a diethylene triamine polyamide resin and a modified aminophenol is used as the hardener. The aggregate is sized as appropriate for the application. For instance, in one example, 100% passes through a #6 sieve, 65 to 90% is retained on a #10 sieve, and 10 to 35% is retained on a number 20 sieve. Of course, other size distributions can be used, such as, 100% passes through a #4 sieve, 30 to 75% passes through a #8 sieve, 5% maximum passes a #1 sieve and 1% maximum passes a #30 sieve.

Once the polymer concrete is applied, it is left to cure, normally 1 to 7 days.

The method described above is preferably applied to a bridge deck surface in a shop environment. In this manner, the possibility of environmental impact by reason of any of the cleaning or conversion coatings solutions entering the environment is minimized. With the wearing surface applied to the bridge deck surface in a shop environment, the completed bridge deck can then be transported to a site for installation on a bridge structure.

Of course, if desired, the surface preparation and wearing surface application steps could be performed in a field environment to repair a portion of a bridge deck surface or apply a new surface. In addition, the sequence depicted in FIG. 1, starting with the buff step and ending with the apply step, is preferably used after field installation of the bridge deck segments to treat exposed surface areas in the vicinity of joints and any portions of the wearing service that might have been damaged in installation.

Figure 2:
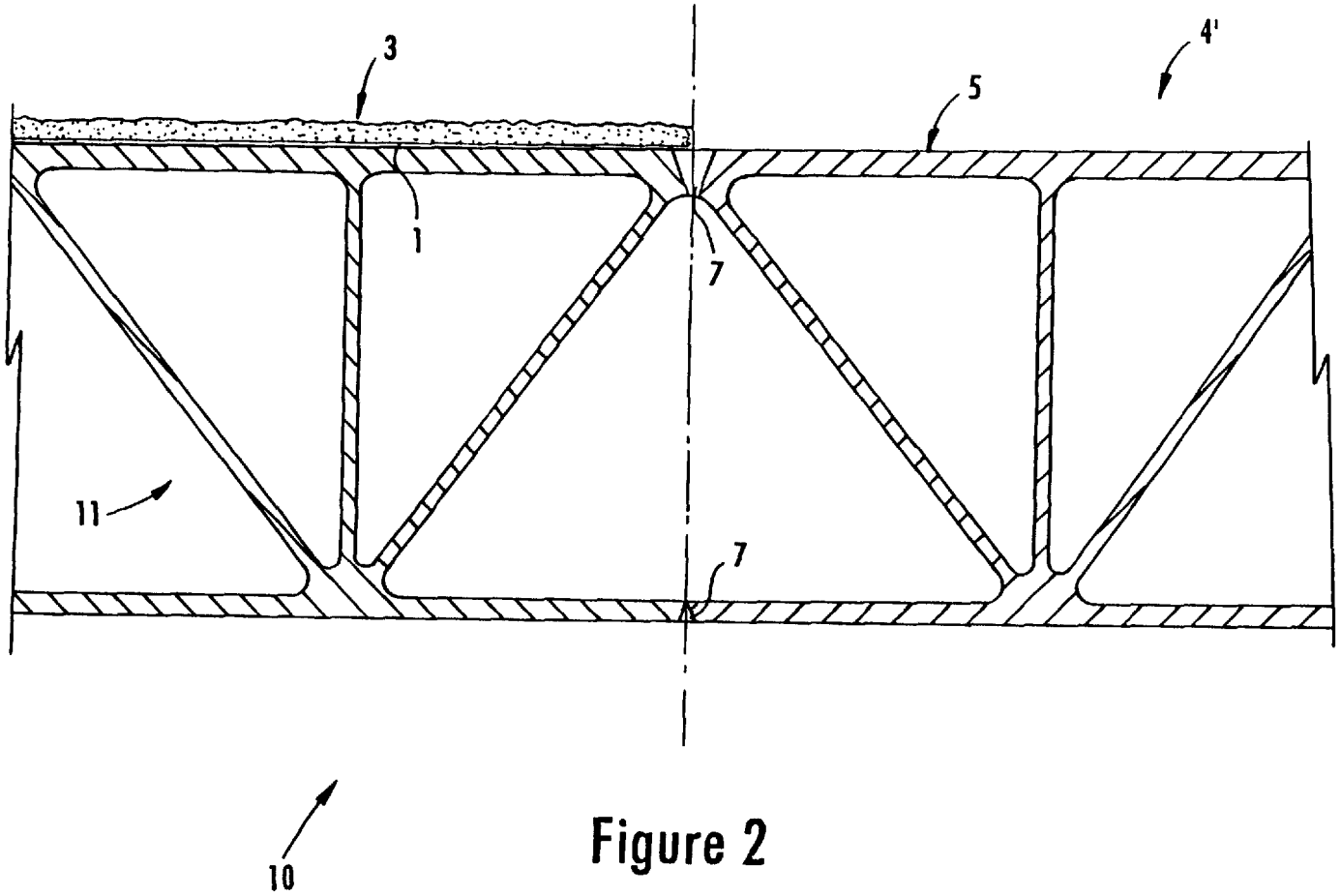
FIG. 2 is a cross-sectional view of a portion of an exemplary aluminum alloy bridge deck construction with a wearing surface bonded thereto.

Referring now to FIG. 2, a cross-section of a portion of an exemplary aluminum alloy bridge deck is generally designated by the reference numeral 10. The bridge deck is depicted in two phases of the inventive method. On the left side of FIG. 2, the bridge deck is shown with a conversion coating 1 and a wearing surface 3 applied thereto. The right side of FIG. 2 depicts the water break free surface 5 prior to formation of the conversion coating. FIG. 2 also shows the welds 7 joining the two isotropic extrusion members 9 and 11.

As described above, a bridge may require one or more segments to make up an entire bridge deck. In this instance, the deck segments must be spliced together, either at a shop or in the field. The location of the splicing will depend on whether a shop-spliced bridge deck could be transported to the bridge site. In either case, deck segments to be spliced together include joint extrusions to facilitate segment attachment.

Figure 3:
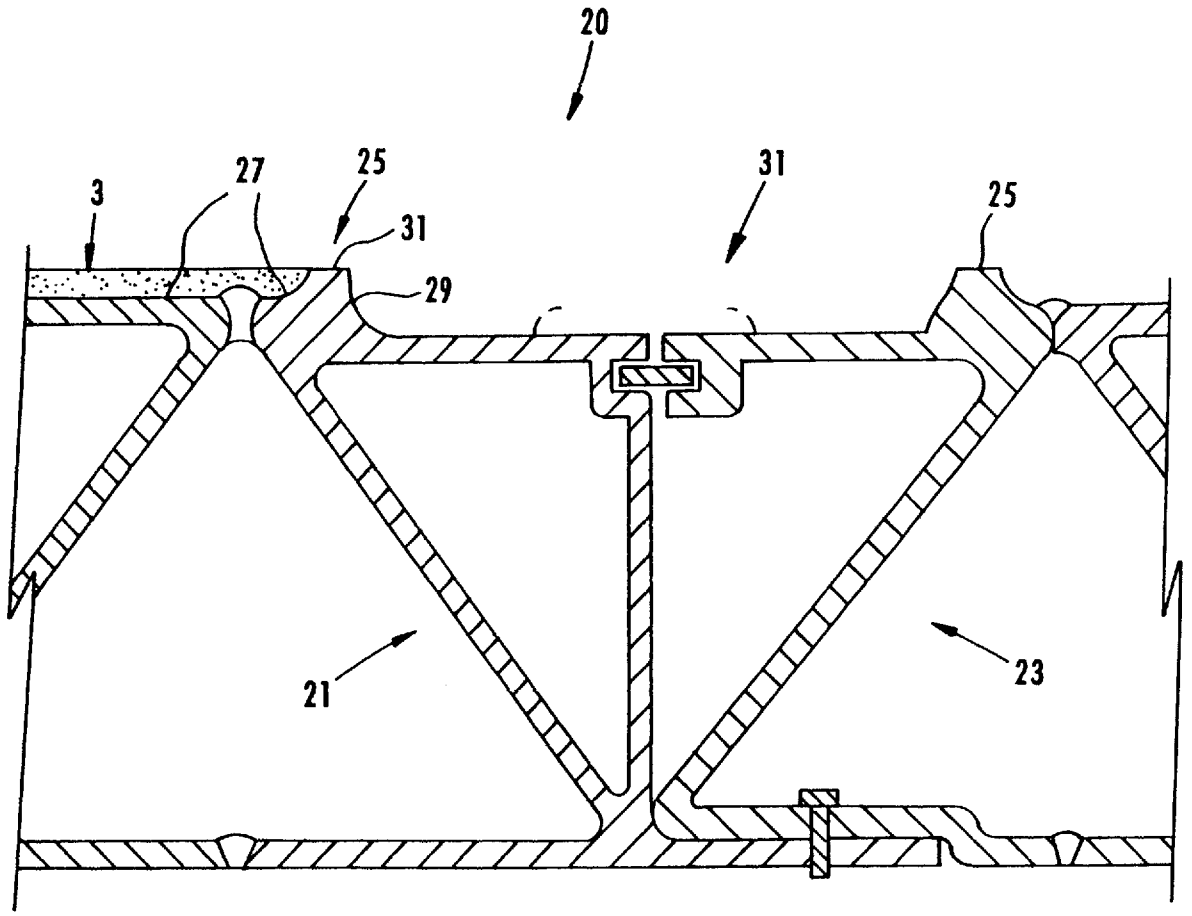
FIG. 3 is a cross-sectional representation of an exemplary bridge deck joint construction showing the inventive bridge deck configuration which minimizes wearing surface to wearing surface bonding.

Referring now to FIG. 3, an exemplary joint is designated by the reference numeral 20. The joint comprises a pair of extrusion joints 21 and 23. It should be understood that the entire joint construction is not shown to facilitate description of this aspect of the invention.

Each of the extrusions 21 and 23 includes a raised portion 25. The raised portion acts as a dam or separator so that the wearing surface 3 which has previously been applied to the upper surface 27 of one bridge deck segment does not have to be bonded to a wearing surface which would be applied in the field to the upper surface 29 of the joint extrusion 21. Thus, the problem explained above wherein the previously applied wearing surfaces generally do not bond tightly with wearing surfaces applied in the field is avoided.

The procedure used for applying the wearing surface in the field is similar to that used off-site or in the shop and may involve use of the previously described materials in the following steps:

1. Buff exposed bridge deck upper surface.
2. Clean exposed bridge deck upper surface.
3. Rinse exposed bridge deck upper surface.
4. Form conversion coating on exposed bridge deck upper surface.
5. Dry conversion coated surface.
6. Apply wearing surface on exposed bridge deck upper surface.

The dam 25 is formed having a height with respect to the surface 27 approximating the height of the wearing surface 3. The height could approximate the height of the wearing surface prior to broadcasting of the final aggregate layer or could include the thickness of this final aggregate layer. When the dam height is made to approximate the thickness of the wearing surface without the final broadcast aggregate layer, the upper surface 31 of the dam 25 can be covered with the broadcast aggregate when the joint area 31 is coated in the field with the wearing surface 3.

Alternatively, the upper surface 31 can remain in its uncoated state and act as part of the road wearing surface if so desired.

The shape of the dam 25 preferably includes the curved portions as depicted in FIG. 2. Other configurations can be used such as a dam which terminates in an apex such that the upper surface thereof would form a line rather than a planar surface as depicted in FIG. 3. Of course, any configuration of the dam can be used providing that it acts as one surface for applying the wearing surface to the bridge deck upper surface except for the joint portions thereof and another surface wherein the wearing surface can be applied after making the joint splice.

It should also be understood that the joint configuration shown in FIG. 3 is merely exemplary. For example, the surfaces 27 and 29 could be aligned on the same plane so that the dam 25 would be spaced from each upper surface an equal amount. The dam could also be formed by welding or mechanically fastening an aluminum shape onto the surface of the extrusion 21 or 23.

As such, an invention has been disclosed in terms of preferred embodiments thereof which fulfill each and every one of the objects of the present invention as set forth hereinabove to provide a new and improved aluminum alloy bridge deck configuration and method of applying a wearing surface thereto.

Of course, various changes, modifications and alterations of the present invention may be contemplated by those skilled in the art without departing from the intended spirit and scope thereof. Accordingly, it is intended that the present invention only be limited by the terms of the appended claims.

What is claimed is:

1. An aluminum alloy bridge deck joint extrusion for use in an aluminum alloy bridge deck comprising:

an extruded length of an aluminum alloy, the extruded length having one of an isotropic and an orthotropic cross-section and first and second upper surfaces;

said first and second upper surfaces separated by a raised portion of said extruded length, said raised portion running in a longitudinal direction of the extruded length and acting as a dam so that a wearing surface applied to said second upper surface as part of a joint between adjacent aluminum alloy bridge deck segments is separated from a wearing surface previously applied to said first upper surface of said extruded length.

2. The joint extrusion of claim 1 wherein the raised portion has a flat upper surface along a length thereof.

3. The joint extrusion of claim 2 wherein said raised portion has said flat upper surface and opposing curved surfaces extending between the flat upper surface and the first and second upper surfaces.

4. The joint extrusion of claim 2 wherein said raised portion has a height approximating a thickness of said wearing surface when applied to at least the first upper surface of said extruded length.

5. A method of forming an aluminum alloy bridge deck joint extrusion for use in an aluminum alloy bridge deck comprising:

extruding a length of an aluminum alloy, the extruded length having one of an isotropic or an orthotropic cross section and first and second upper surfaces; and forming a raised portion separating said first and second upper surfaces, said raised portion running in a longitudinal direction of the extruded length and acting as a dam so that polymer concrete applied to said second upper surface as part of a joint between adjacent aluminum alloy bridge deck segments is separated from polymer concrete previously applied to said first upper surface of said extruded length.

6. The method of claim 5 wherein said raised portion includes a flat upper surface and opposing curved surfaces extending between the flat upper surface and the first and second upper surface.

7. The method of claim 5 wherein said raised portion has a height approximating a thickness of said wearing surface when applied to at least the first upper surface of said extruded length.

5,836,029
9 10

* * * * *